US012262739B2

(12) United States Patent
Jung et al.

(10) Patent No.: US 12,262,739 B2
(45) Date of Patent: Apr. 1, 2025

(54) AEROSOL GENERATING SYSTEM

(71) Applicant: KT&G CORPORATION, Daejeon (KR)

(72) Inventors: Sun Hwan Jung, Daejeon (KR); Sung Hoon Ha, Daejeon (KR); Chan Min Kwon, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 134 days.

(21) Appl. No.: 17/605,082

(22) PCT Filed: Jul. 6, 2021

(86) PCT No.: PCT/KR2021/008565
§ 371 (c)(1),
(2) Date: Oct. 20, 2021

(87) PCT Pub. No.: WO2022/014932
PCT Pub. Date: Jan. 20, 2022

(65) Prior Publication Data

US 2024/0049782 A1 Feb. 15, 2024

(30) Foreign Application Priority Data

Jul. 13, 2020 (KR) ..... 10-2020-0086437

(51) Int. Cl.

| | |
|---|---|
| ***A24F 40/20*** | (2020.01) |
| ***A24D 1/02*** | (2006.01) |
| ***A24D 1/20*** | (2020.01) |
| ***A24D 3/06*** | (2006.01) |
| ***A24D 3/17*** | (2020.01) |
| ***A24F 40/30*** | (2020.01) |
| ***A24F 40/42*** | (2020.01) |
| ***A24F 40/465*** | (2020.01) |
| ***A24F 40/57*** | (2020.01) |

(52) U.S. Cl.
CPC ..... *A24F 40/20* (2020.01); *A24D 1/02* (2013.01); *A24D 1/20* (2020.01); *A24F 40/30* (2020.01); *A24F 40/42* (2020.01); *A24F 40/465* (2020.01); *A24F 40/57* (2020.01); *A24D 3/061* (2013.01); *A24D 3/17* (2020.01)

(58) Field of Classification Search
CPC ..... A24F 40/20; A24F 40/30; A24F 40/42; A24F 40/57; A24F 40/465; A24D 1/02; A24D 1/20; A24D 3/17; A24D 3/061
See application file for complete search history.

(56) References Cited

U.S. PATENT DOCUMENTS

| | | | | |
|---|---|---|---|---|
| 5,042,509 | A | 8/1991 | Banerjee et al. | |
| 5,133,367 | A * | 7/1992 | Keritsis | A24F 47/00 131/273 |
| 5,144,962 | A | 9/1992 | Counts et al. | |
| 8,602,037 | B2 | 12/2013 | Inagaki | |
| 10,881,131 | B2 | 1/2021 | Matsumoto et al. | |
| 10,888,120 | B2 | 1/2021 | Zuber | |
| 2007/0074734 | A1 | 4/2007 | Braunshteyn et al. | |
| 2008/0092912 | A1 | 4/2008 | Robinson et al. | |
| 2010/0031967 | A1 | 2/2010 | Inagaki | |
| 2015/0216231 | A1* | 8/2015 | Roudier | A24F 42/00 131/330 |
| 2016/0150825 | A1 | 6/2016 | Mironov et al. | |
| 2016/0205993 | A1* | 7/2016 | Börjesson | A24B 15/183 |
| 2016/0286862 | A1* | 10/2016 | Silvetrini | A24F 40/485 |
| 2017/0340018 | A1* | 11/2017 | Thorens | H05B 3/44 |
| 2018/0317553 | A1 | 11/2018 | Blandino et al. | |
| 2019/0000133 | A1 | 1/2019 | Park et al. | |
| 2019/0208819 | A1 | 7/2019 | Tucker et al. | |
| 2019/0274354 | A1* | 9/2019 | Sur | H05B 1/0244 |
| 2020/0368462 | A1 | 11/2020 | Lee et al. | |
| 2020/0397035 | A1 | 12/2020 | Lee et al. | |
| 2020/0404969 | A1 | 12/2020 | Zuber et al. | |
| 2021/0045451 | A1 | 2/2021 | Choi et al. | |
| 2021/0068454 | A1* | 3/2021 | Jung | A24F 40/46 |

FOREIGN PATENT DOCUMENTS

| | | | |
|---|---|---|---|
| CN | 101626699 | A | 1/2010 |
| CN | 110035671 | A | 7/2019 |
| CN | 110447956 | A | 11/2019 |
| CN | 110475488 | A | 11/2019 |
| EP | 2156756 | A1 | 2/2010 |
| EP | 3 603 426 | A1 | 2/2020 |
| JP | 3-232481 | A | 10/1991 |
| JP | 2019-501633 | A | 1/2019 |
| JP | 2021-510503 | A | 4/2021 |
| KR | 10-2009-0114416 | A | 11/2009 |
| KR | 10-1314895 | B1 | 10/2013 |

(Continued)

OTHER PUBLICATIONS

International Search Report dated Oct. 22, 2021 in International Application PCT/KR2021/008565.

(Continued)

*Primary Examiner* — Christopher M Rodd
*Assistant Examiner* — Adam Z Baratz
(74) *Attorney, Agent, or Firm* — Sughrue Mion, PLLC

(57) ABSTRACT

An aerosol-generating system includes a cigarette and an aerosol-generating apparatus. The cigarette includes a medium part including a tobacco material, a flavor unit including a flavoring material and a moisturizer, and a wrapper configured to wrap the medium part and the flavor unit. The aerosol-generating apparatus includes a first heater arranged on a portion corresponding to the medium part and configured to directly heat the medium part and indirectly heat the flavor unit by using heat transmitted through the wrapper, and a processor configured to control the first heater to make the aerosol-generating apparatus operate in a smoke-free mode in which no visible smoke is generated.

9 Claims, 6 Drawing Sheets

(56) References Cited

FOREIGN PATENT DOCUMENTS

| | | | | |
|---|---|---|---|---|
| KR | 10-2016-0092988 | A | 8/2016 | |
| KR | 10-2017-0070216 | A | 6/2017 | |
| KR | 10-2017-0123689 | A | 11/2017 | |
| KR | 10-1937075 | B1 | 1/2019 | |
| KR | 10-2020-0057489 | A | 5/2020 | |
| KR | 10-2020-0068449 | A | 6/2020 | |
| WO | 2008/133091 | A1 | 11/2008 | |
| WO | 2020/105943 | A1 | 5/2020 | |
| WO | WO-2020101258 | A1 * | 5/2020 | ..... A24B 15/167 |
| WO | 2020/116777 | A1 | 6/2020 | |

OTHER PUBLICATIONS

Japanese Office Action dated Jan. 31, 2023 in Japanese Application No. 2021-561987.
Japanese Office Action dated Aug. 29, 2023 in Application No. 2021-561987.
Office Action issued Jun. 28, 2022 in Korean Application No. 10-2020-0086437.
Extended European Search Report issued Jul. 12, 2022 in European Application No. 21794075.8.
Chinese Office Action dated Jun. 21, 2024 in Application No. 202180005480.9.

* cited by examiner

AEROSOL GENERATING SYSTEM

CROSS REFERENCE TO RELATED APPLICATIONS

This application is a National Stage of International Application No. PCT/KR2021/008565, filed Jul. 6, 2021, claiming priority to Korean Patent Application No. 10-2020-0086437, filed Jul. 13, 2020.

TECHNICAL FIELD

The present disclosure relates to an aerosol-generating system.

BACKGROUND ART

Recently, the demand for alternative methods to overcome the disadvantages of traditional cigarettes has increased. For example, there is growing demand for an aerosol generating device which generates aerosol by heating an aerosol generating material, rather than by combusting cigarettes.

The fact that no visible smoke is generated when an aerosol-generating apparatus is used indicates that a user may use the aerosol-generating apparatus without restrictions of place or environment, and when visible smoke is generated, a visual satisfaction may be provided to the user. Therefore, there is a need for a technology in which the aerosol-generating apparatus operates in any one of a smoke mode and a smoke-free mode according to a user's selection.

DESCRIPTION OF EMBODIMENTS

Technical Problem

One or more embodiments provide an aerosol-generating system. In detail, one or more embodiments provide a system for controlling a first heater to operate in a smoke-free mode or individually controlling the first heater and a second heater to operate in a smoke mode. The technical problems of the present disclosure are not limited to the above-described problems, and other technical problems may be inferred from the embodiments to be described hereinafter.

Solution to Problem

According to an embodiment of the present disclosure, an aerosol-generating system includes a cigarette and an aerosol-generating apparatus. The cigarette includes a medium part including a tobacco material, a flavor unit including a flavoring material and a moisturizer, and a wrapper configured to wrap the medium part and the flavor unit. The aerosol-generating apparatus includes a first heater arranged on a portion corresponding to the medium part and configured to directly heat the medium part and indirectly heat the flavor unit by using heat transmitted through the wrapper, and a processor configured to control the first heater to make the aerosol-generating apparatus operate in a smoke-free mode in which no visible smoke is generated.

Advantageous Effects of Disclosure

An aerosol-generating system may operate in a smoke-free mode to use an aerosol-generating apparatus without restrictions of place or environment or may provide convenience and satisfaction to a user by operating in a smoke mode for visual satisfaction of the user. In the smoke-free mode, the aerosol-generating system may heat a cigarette at a temperature at which nicotine is transmitted but no visible smoke is generated, and thus may increase the continuity of transition of a flavoring material. Also, the aerosol-generating system may provide two types of smoke modes and thus may provide a different smoking sensation in each of the smoke modes.

Effects of the present disclosure are not limited to the descriptions above, and effects that are not stated herein may be clearly understood by one of ordinary skill in the art from the present specification and the attached drawings.

BEST MODE

Figure 1:
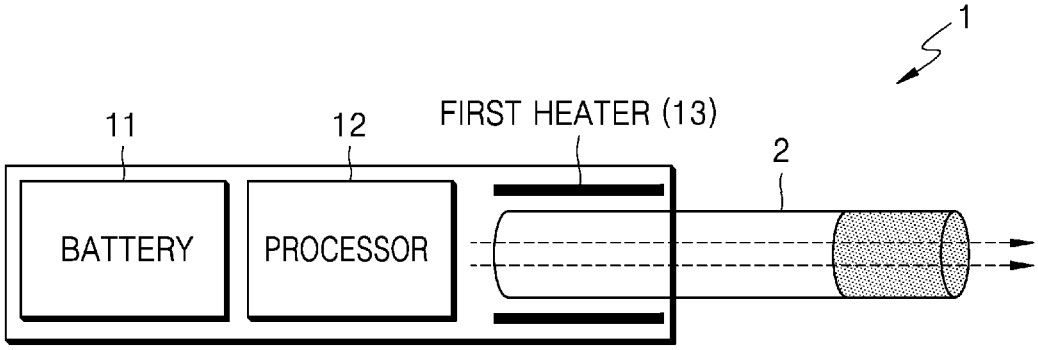
FIGS. 1 through 3 are diagrams showing examples in which a cigarette is inserted into an aerosol generating device.

According to an aspect of the present disclosure, an aerosol-generating system includes a cigarette and an aerosol-generating apparatus. The cigarette includes a medium part including a tobacco material, a flavor unit including a flavoring material and a moisturizer, and a wrapper configured to wrap the medium part and the flavor unit. The aerosol-generating apparatus includes a first heater arranged on a portion corresponding to the medium part and configured to directly heat the medium part and indirectly heat the flavor unit by using heat transmitted through the wrapper, and a processor configured to control the first heater to make the aerosol-generating apparatus operate in a smoke-free mode in which no visible smoke is generated.

The first heater may be configured to directly heat the medium part at a temperature, at which an aerosol containing the tobacco material is generated from the medium part but no visible smoke is generated, and indirectly heat the flavor unit at a temperature at which an aerosol containing the flavoring material is generated from the flavor unit but no visible smoke is generated.

The first heater may be configured to directly heat the medium part at a temperature equal to or greater than about 120° C. and less than or equal to about 150° C. and indirectly heat the flavor unit at a temperature less than or equal to about 100° C.

The aerosol-generating apparatus may further include a cartridge configured to store an aerosol-generating material, and a second heater configured to heat the aerosol-generating material, and the processor may be configured to individually control the first heater and the second heater to make the aerosol-generating apparatus operate in a smoke mode in which visible smoke is generated.

The processor may be configured to operate both the first heater and the second heater in a first smoke mode.

The first heater may be configured to indirectly heat the flavor unit at a temperature greater than about 150° C.

The processor may be configured to operate only the first heater from among the first heater and the second heater in a second smoke mode, and the first heater may be configured to indirectly heat the flavor unit at a temperature greater than about 150° C.

The wrapper may include a thermally conductive wrapper, and the first heater may be configured to directly heat a first portion of the wrapper that corresponds to the medium part and indirectly heat the flavor unit by using heat transmitted from the first portion of the wrapper to a second portion of the wrapper that corresponds to the flavor unit.

The tobacco material may be obtained by cooling or reducing a component that is evaporated or volatilized through thermal treatment of pipe tobacco powder at a temperature between about 200° C. and about 250° C.

The flavor unit may include a flavoring material of between about 4.2 mg and about 30 mg.

MODE OF DISCLOSURE

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

It will be understood that although the terms "first," "second," etc. may be used herein to describe various components, these components should not be limited by these terms. These components are only used to distinguish one component from another.

In embodiments below, the term "downstream" indicates relative locations of segments forming an aerosol-generating product. The aerosol-generating product includes an upstream portion (that is, a portion through which air is introduced) and a downstream portion (that is, a portion through which air is discharged) opposite to the upstream portion. When the aerosol-generating product is used, a user may have the downstream portion of the aerosol-generating product in his/her mouth.

Hereinafter, one or more embodiments of the present disclosure will be described in detail with reference to the accompanying drawings.

Figure 2:
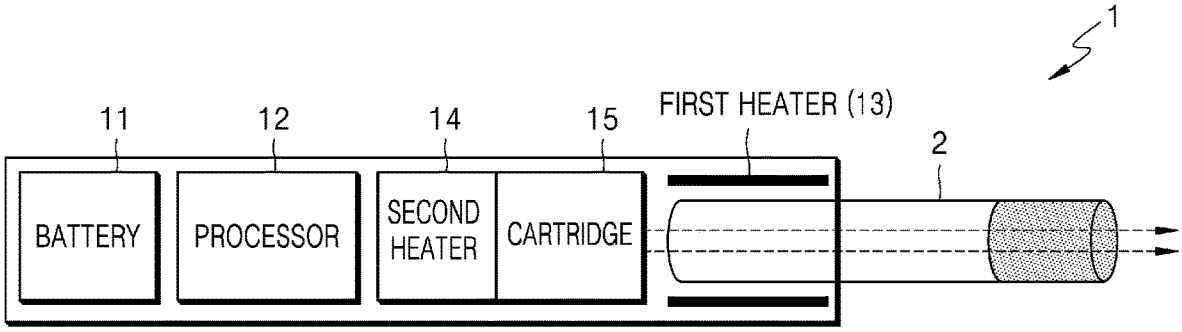
Figure 3:
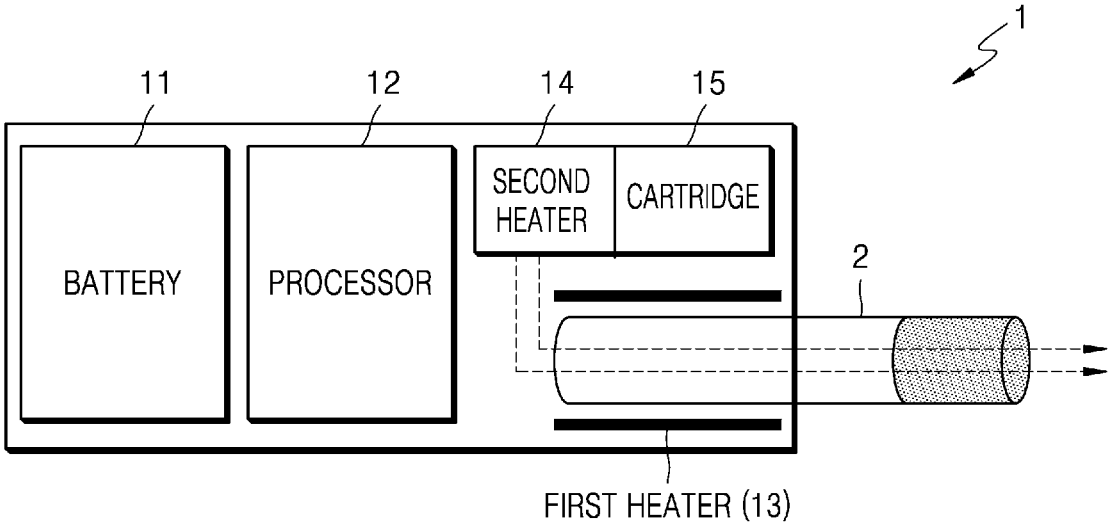

FIGS. 1 through 3 are diagrams showing examples in which a cigarette is inserted into an aerosol generating device.

Referring to FIG. 1, an aerosol-generating apparatus 1 includes a battery 11, a processor 12, and a first heater 13, and referring to FIGS. 2 and 3, the aerosol-generating apparatus 1 further includes a second heater 14 and a cartridge 15. Also, a cigarette 2 may be inserted in an internal space of the aerosol-generating apparatus 1.

In the aerosol-generating apparatus 1 of FIGS. 1 to 3, components related to the present embodiment are illustrated. Therefore, one of ordinary skill in the art could understand that general-purpose components, other than the components of FIGS. 1 to 3, may be further included in the aerosol-generating apparatus 1.

FIG. 1 illustrates that the battery 11, the processor 12, and the first heater 13 are arranged in a row, and FIG. 2 illustrates that the battery 11, the processor 12, the first heater 13, the second heater 14, and the cartridge 15 are arranged in a row. Also, FIG. 3 illustrates that the first heater 13 and the second heater 14 are arranged in parallel. However, the internal structure of the aerosol generating device 1 is not limited to the structures illustrated in FIGS. 1 through 3. In other words, according to the design of the aerosol generating device 1, the battery 11, the processor 12, the first heater 13, and the second heater 14 may be differently arranged.

When the cigarette 2 is inserted into the aerosol-generating apparatus 1, the aerosol-generating apparatus 1 may operate the first heater 13 and/or the second heater 14 and generate an aerosol. The aerosol generated by the first heater 13 and/or the second heater 14 passes through the cigarette 2 and is delivered to a user.

According to necessity, even when the cigarette 2 is not inserted into the aerosol-generating apparatus 1, the aerosol-generating apparatus 1 may heat the first heater 13 and/or the second heater 14.

The battery 11 may supply power to be used for the aerosol generating device 1 to operate. For example, the battery 11 may supply power to heat the first heater 13 or the second heater 14, and may supply power for operating the processor 12. Also, the battery 11 may supply power for operations of a display, a sensor, a motor, etc. mounted in the aerosol generating device 1.

The processor 12 may generally control operations of the aerosol generating device 1. In detail, the processor 12 may control not only operations of the battery 11, the first heater 13, and the second heater 14, but also operations of other components included in the aerosol generating device 1. Also, the processor 12 may check a state of each of the components of the aerosol generating device 1 to determine whether or not the aerosol generating device 1 is able to operate.

A processor 12 can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The first heater 13 may be heated by the power supplied from the battery 11. For example, when the cigarette 2 is inserted into the aerosol generating device 1, the first heater 13 may be located outside the cigarette 2. Therefore, the heated first heater 13 may generate the aerosol by increasing a temperature of an aerosol-generating material in the cigarette 2.

The first heater 13 may be an electro-resistive heater. For example, the first heater 13 may include an electrically insulating substrate (e.g., a substrate including polyimide) and an electrically conductive track, and the first heater 13 may be heated when currents flow through the electrically conductive track. However, the first heater 13 is not limited to the example described above and may include all heaters which may be heated to a desired temperature. Here, the desired temperature may be pre-set in the aerosol generating device 1 or may be set by a user.

As another example, the first heater 13 may include an induction heater. In detail, the first heater 13 may include an electrically conductive coil for heating a cigarette in an induction heating method, and the cigarette may include a susceptor which may be heated by the induction heater.

For example, the first heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of first heaters 13. Here, the plurality of first heaters 13 may be inserted into the cigarette 2 or may be arranged outside the cigarette 2. Also, some of the plurality of first heaters 13 may be inserted into the cigarette 2 and the others may be arranged outside the cigarette 2. In addition, the shape of the first heater 13 is not limited to the shapes illustrated in FIGS. 1 through 3 and may include various shapes.

The second heater 14 may generate an aerosol by heating an aerosol-generating material (e.g., a liquid composition) stored in the cartridge 15, and the generated aerosol may be delivered to the user by passing through the cigarette 2. In other words, the aerosol, which is heated and generated by the second heater 14, may move along an air flow passage of the aerosol-generating apparatus 1, and the air flow passage may be configured such that the aerosol generated by the second heater 14 passes through the cigarette 2 to be delivered to the user.

For example, the cartridge 15 may include a liquid storage and a liquid delivery element, but is not limited thereto. For example, the second heater 14 and the cartridge 15 may be included in the aerosol-generating apparatus 1 as independent modules.

The liquid storage may store a liquid composition. For example, the liquid composition may be a liquid including a tobacco-containing material having a volatile tobacco flavor component, or a liquid including a non-tobacco material. The cartridge 15 may be formed to be attached to or detached from the second heater 14 or may be integrally formed with the second heater 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the second heater 14. For example, the liquid delivery element may be a wick such as cotton fiber, ceramic fiber, glass fiber, or porous ceramic, but is not limited thereto.

The second heater 14 is an element for heating the liquid composition delivered by the liquid delivery element. For example, the second heater 14 may be a metal heating wire, a metal hot plate, a ceramic heater, or the like, but is not limited thereto. In addition, the second heater 14 may include a conductive filament such as nichrome wire and may be positioned as being wound around the liquid delivery element. The second heater 14 may be heated by a current supply and may transfer heat to the liquid composition in contact with the heating element, thereby heating the liquid composition. As a result, aerosol may be generated.

For example, the second heater 14 and cartridge 15 may be referred to as a cartomizer or an atomizer, but it is not limited thereto.

The aerosol generating device 1 may further include general-purpose components in addition to the battery 11, the processor 12, the first heater 13, and the second heater 14. For example, the aerosol generating device 1 may include a display capable of outputting visual information and/or a motor for outputting haptic information. Also, the aerosol generating device 1 may include at least one sensor (a puff sensor, a temperature sensor, a cigarette insertion detecting sensor, etc.). Also, the aerosol generating device 1 may be formed as a structure that, even when the cigarette 2 is inserted into the aerosol generating device 1, may introduce external air or discharge internal air.

Although not illustrated in FIGS. 1 through 3, the aerosol generating device 1 and an additional cradle may form together a system. For example, the cradle may be used to charge the battery 11 of the aerosol generating device 1. Alternatively, the first heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage formed in the aerosol generating device 1 may be adjusted by the user. Accordingly, the amount of smoke and a smoking impression may be adjusted by the user. As another example, the external air may flow into the cigarette 2 through at least one hole formed in a surface of the cigarette 2.

Hereinafter, the examples of the cigarette 2 will be described with reference to FIG. 4.

Figure 4:
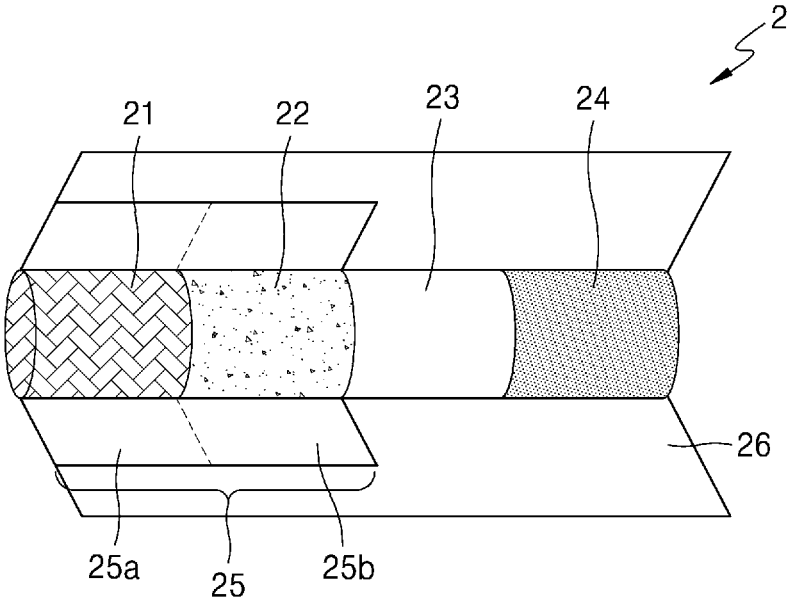
FIG. 4 illustrates an example of a cigarette.

FIG. 4 illustrates an example of a cigarette.

Referring to FIG. 4, the cigarette 2 includes a flavor unit 21, a medium part 22, a filter, a wrapper 25, and an outer shell 26, and the filter includes a cooler 23 and a mouth filter 24. A first portion described with reference to FIGS. 1 to 3 includes the flavor unit 21 and the medium part 22, and a second portion includes the filter. According to necessity, the filter may further include a segment configured to perform other functions. In an embodiment, a downstream end portion of the flavor unit 21 may be connected to the medium part 22, and a downstream end portion of the medium part 22 may be connected to the filter.

The flavor unit 21, the medium part 22, the cooler 23, and the mouth filter 24 may be sequentially aligned in a direction in which air in the cigarette 2 flows, that is, a lengthwise direction in which the cigarette 2 extends. Accordingly, the aerosol generated from at least one of the flavor unit 21 and the medium part 22 may form an airflow by sequentially passing through the flavor unit 21, the medium part 22, the cooler 23, and the mouth filter 24, and accordingly, a user may inhale the aerosol from the mouth filter 24.

The flavor unit 21 may include a flavoring material and a moisturizer. The flavoring material included in the flavor unit 21 may correspond to menthol, but is not limited thereto. The flavor unit 21 may include a flavoring material of between about 4.2 mg and about 30 mg. Also, the flavor unit 21 may include other additives such as organic acid.

For example, the moisturizer may include at least one of glycerin, propylene glycol, ethylene glycol, dipropylene glycol, diethylene glycol, triethylene glycol, tetraethylene glycol, and oleyl alcohol, but it is not limited thereto. As the flavor unit 21 is heated, an aerosol including a flavoring material may be generated. For example, the flavor unit 21 may include a sheet of non-tobacco materials (e.g., paper), and the flavoring material and the moisturizer may be impregnated with the paper.

The medium part 22 may include a tobacco material including nicotine. The medium part 22 may include tobacco materials such as tobacco leaves, reconstituted tobaccos, and tobacco granules. The medium part 22 may be formed in the form of sheets, strands, or pipe tobaccos formed of tiny bits cut from a tobacco sheet.

The medium part 22 may include a thermally treated tobacco material. The medium part 22 may include a tobacco material obtained as an aerosol generated from the heated pipe tobaccos are cooled. For example, the thermally treated tobacco material may be obtained by cooling or reducing components that are evaporated or volatilized through thermal treatment of pipe tobacco powder at a temperature between about 200° C. and about 250° C. Compared to the medium part 22 that does not include a thermally treated tobacco material, the medium part 22 including the thermally treated tobacco material has an increasing emission amount of nicotine when heated. When the medium part 22 includes the thermally treated tobacco material, a sufficient nicotine yield may be achieved even though the medium part 22 is heated at a low temperature.

Also, the medium part 22 may further include a pH regulator. The pH regulator may be alkaline and may include, for example, at least one of $K_2CO_3$, $NaHCO_3$, and CaO. However, a material included in the pH regulator is not limited to the above materials, and the pH regulator may include a material emitting few unpleasant smells during smoking.

An alkaline pH regulator increases a pH level of a tobacco material included in the medium part 22. Compared to a case where the alkaline pH regulator is not included, the nicotine emission may increase when the medium part 22 including an alkaline pH regulator is heated. When the medium part 22 includes the alkaline pH regulator, a sufficient nicotine yield may be achieved even though the medium part 22 is heated at a low temperature.

As at least one of the flavor unit 21 and the medium part 22 is heated, the cooler 23 cools the generated aerosol. Therefore, the user may inhale the aerosol that is cooled at an appropriate temperature.

In an embodiment, the cooler 23 may be a hollow cellulose acetate filter. In another embodiment, the cooler 23 may be a filter including polymer fibers. The cooler 23 may include a woven polymer fiber or a crimped polymer sheet. For example, the polymer may be formed from a material selected from the group consisting of polyethylene (PE), polypropylene (PP), polyvinyl chloride (PVC), polyethylene terephthalate (PET), polylactic acid (PLA), cellulose acetate (CA), and aluminum foil.

The mouth filter 24 may be a cellulose acetate filter. The mouth filter 24 may have a cylindrical shape or a tube shape including a hollow hole therein. Also, the mouth filter 24 may be of a recess type.

The mouth filter 24 may be manufactured to generate flavors. For example, a flavoring material may be sprayed on the mouth filter 24, or a separate fiber, on which a flavoring material is spread, may be inserted into the mouth filter 24. The flavoring material included in the mouth filter 24 may be menthol, but is not limited thereto. The mouth filter 24 may include a flavoring material of between about 1.8 mg and about 4.2 mg.

In another embodiment, the mouth filter 24 may include at least one capsule. Here, the capsule may generate a flavor or an aerosol. For example, the capsule may have a configuration in which a liquid containing a flavoring material is wrapped with a film. The capsule may have a spherical or cylindrical shape, but is not limited thereto.

The cigarette 2 may be packaged via the wrapper 25 and the outer shell 26. The wrapper 25 may be arranged to correspond to the medium part 22 and the flavor unit 21 and may surround the same. A first portion 25*a* of the wrapper 25 may correspond to and surround the medium part 22, and a second portion 25*b* of the wrapper 25 may correspond to and surround the flavor unit 21. The outer shell 26 may surround the entire cigarette 2 including the wrapper 25. The wrapper 25 or the outer shell 26 may have at least one hole through which external air may be introduced or internal air may be discharged.

The wrapper 25 may be a thermally conductive wrapper 25. For example, although the first portion 25*a* of the wrapper 25 is heated only, heat may be transmitted from the first portion 25*a* of the wrapper 25 to the second portion 25*b* thereof. The wrapper 25 may be formed of an aluminum laminate, but is not limited thereto.

Figure 5:
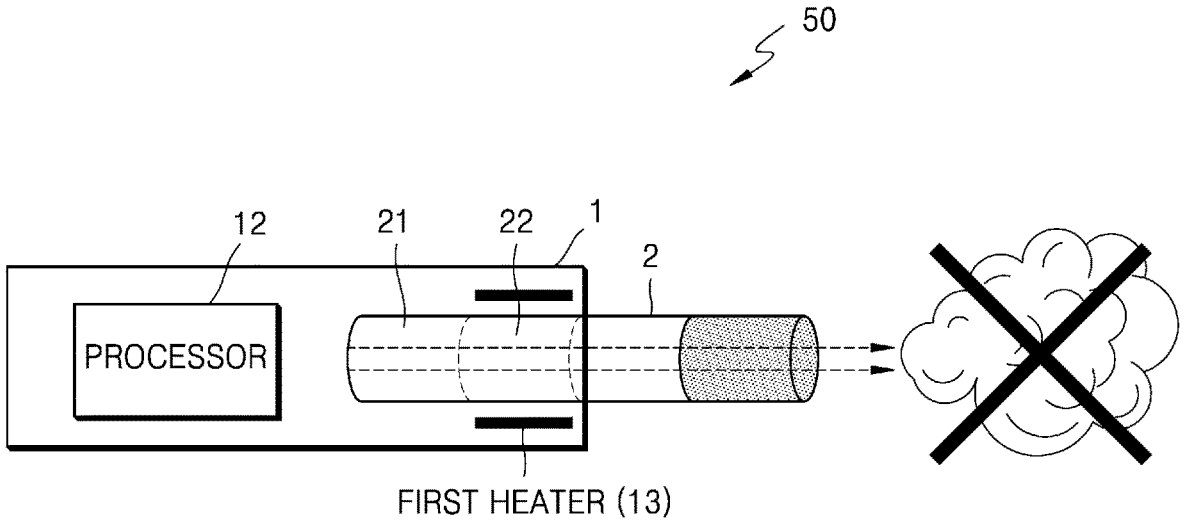
FIG. 5 illustrates an aerosol-generating system operating in a smoke-free mode, according to an embodiment.

FIG. 5 illustrates an aerosol-generating system operating in a smoke-free mode, according to an embodiment.

Referring to FIG. 5, an aerosol-generating system 50 may include the cigarette 2 and the aerosol-generating apparatus 1. The cigarette 2 may include the flavor unit 21 and the medium part 22. The aerosol-generating apparatus 1 may include the first heater 13 and a processor 12. Also, the cigarette 2 may be inserted in the internal space of the aerosol-generating apparatus 1.

The first heater 13 may be arranged on a portion of the cigarette 2 that corresponds to the medium part 22 and may heat the medium part 22, wherein the cigarette 2 is inserted into the aerosol-generating apparatus 1. The first heater 13 may directly heat the medium part 22 and indirectly heat the flavor unit 21. When the first heater 13 heats the medium part 22, heat may be transmitted to the flavor unit 21 through a wrapper (not illustrated) wrapping the medium part 22 and the flavor unit 21. The first heater 13 may indirectly heat the flavor unit 21 by using the heat transmitted through the wrapper. The flavor unit 21 that is indirectly heated may be heated at a lower temperature than the medium part 22 that is directly heated.

Referring back to FIG. 4, the first heater 13 may directly heat the first portion 25*a* of the wrapper 25 that corresponds to the medium part 22. The heat may be generated from the first portion 25*a* of the wrapper 25 and may be transmitted to the second portion 25*b* of the wrapper 25 that corresponds to the flavor unit 21. The flavor unit 21 may be indirectly heated by the heat transmitted to the second portion 25*b* of the wrapper 25.

The expression "directly heat" is distinguished from the expression "indirectly heat." Although the medium part 22 receives heat through the first portion 25*a* of the wrapper 25, the first heater 13 is arranged on a portion corresponding to the medium part 22, and the medium part 22 is directly heated unlike the flavor unit 21. Thus, the heating of the medium part 22 is referred to as "direct heating," whereas the heating of the flavor unit 21 is referred to as "indirect heating."

The aerosol-generating apparatus 1 may operate in one of a smoke-free mode, in which no visible smoke is generated, and a smoke mode, in which visible smoke is generated. In the smoke-free mode, the aerosol-generating apparatus 1 may generate an aerosol that does not include visible smoke. Also, in the smoke mode, the aerosol-generating apparatus 1 may generate the aerosol including visible smoke. Although an aerosol is generated according to atomization amount or saturation degrees of materials included in the aerosol, visible smoke may be or may not be generated. Although no visible smoke is generated (that is, even in the smoke-free mode), components such as nicotine and flavors may be transited. The operation of the aerosol-generating apparatus 1 in the smoke-free mode is described with reference to FIG. 5, and the operation of the aerosol-generating apparatus 1 in the smoke mode is described below with reference to FIG. 6.

In the smoke-free mode, the aerosol-generating apparatus 1 may not generate the visible smoke and may generate an aerosol. The processor 12 may control the first heater 13 to enable the aerosol-generating apparatus 1 to operate in the smoke-free mode.

The aerosol-generating apparatus 1 may use a single heater (i.e., the first heater 13) to heat the flavor unit 21 and the medium part 22 at different temperatures by employing a method of indirectly heating the flavor unit 21. The aerosol-generating apparatus 1 may use the single heater (i.e., the first heater 13) to directly heat the medium part 22 for transiting a tobacco material at a relatively high temperature and indirectly heat the flavor unit 21 capable of generating visible smoke at a relatively low temperature, thereby operating in the smoke-free mode.

The first heater 13 may directly heat the medium part 22 at a temperature, at which an aerosol containing a tobacco material is generated from the medium part 22 and no visible smoke is generated, and may indirectly heat the flavor unit 21 at a temperature, at which an aerosol containing a flavoring material is generated from the flavor unit 21 and no visible smoke is generated.

Visible smoke, which is generated as the cigarette 2 is heated, may be generated from the flavor unit 21, and the first heater 13 may heat the flavor unit 21 at a temperature less than a threshold temperature at which the visible smoke is generated from the flavor unit 21. At the same time, the first heater 13 may heat the medium part 22 at a certain temperature or higher for nicotine transition.

In an embodiment, 150° C. is a temperature at which no visible smoke is generated from the flavor unit 21, and the first heater 13 may indirectly heat the flavor unit 21 at a temperature less than or equal to about 150° C. by directly heating the medium part 22 at a temperature less than or equal to about 220° C. At the same time, the first heater 13 may directly heat the medium part 22 at a temperature greater than or equal to about 100° C. to enable the aerosol containing the tobacco material to be generated from the medium part 22 and the aerosol containing the flavoring material to be generated from the flavor unit 21. The temperature at which the flavor unit 21 and the medium part 22 are heated in the smoke-free mode is not limited to the above example, and the temperature may be differently determined according to types and a composition ratio of materials including the tobacco 2 and settings of the aerosol-generating apparatus 1.

As the medium part 22 includes a thermally heated tobacco material or a pH regulator, a sufficient amount of nicotine may be discharged from the cigarette 2 even though the medium part 22 is heated at a lower temperature in the smoke-free mode than in the smoke mode. Therefore, a sufficient amount of nicotine may be discharged from the cigarette 2 even though the aerosol-generating system 50 operates in either the smoke-free mode or the smoke mode.

In an embodiment, the processor 12 may control the first heater 13 to make the aerosol-generating apparatus 1 operate in the smoke mode. In the smoke mode, the first heater 13 may indirectly heat the flavor unit 21 at a temperature greater than about 150° C. The first heater 13 may generate visible smoke from the flavor unit 21 by indirectly heating the flavor unit 21 at a higher temperature than in the smoke-free mode. For example, the first heater 13 may directly heat the medium part 22 at a temperature greater than about 150° C. to enable the flavor unit 21 to be indirectly heated at a temperature greater than about 150° C. However, the temperature at which the flavor unit 21 and the medium part 22 are heated in the smoke mode is not limited to the above example, and the temperature may be differently determined according to types and a composition ratio of materials included in the cigarette 2 and settings of the aerosol-generating apparatus 1.

The aerosol-generating apparatus 1 may further include a second heater (not illustrated) and a cartridge (not illustrated). In the smoke-free mode, the processor 12 may only operate the first heater 13 from among the first heater 13 and the second heater. A method in which the processor 12 controls the first heater 13 in the smoke-free mode is the same as those described with reference to FIG. 5.

In the smoke-free mode, the aerosol-generating apparatus 1 may increase the transition continuity of the flavoring material by heating the cigarette 2 at a temperature at which nicotine is transited but no visible smoke is generated. For example, the aerosol-generating apparatus 1 may perform the transition of nicotine by directly heating the medium part 22 at a temperature greater than or equal to about 100° C. and less than or equal to about 200° C., and may also increase the transition continuity of the flavoring material by indirectly heating the flavor unit 21 at a temperature less than or equal to about 150° C.

Figure 6:
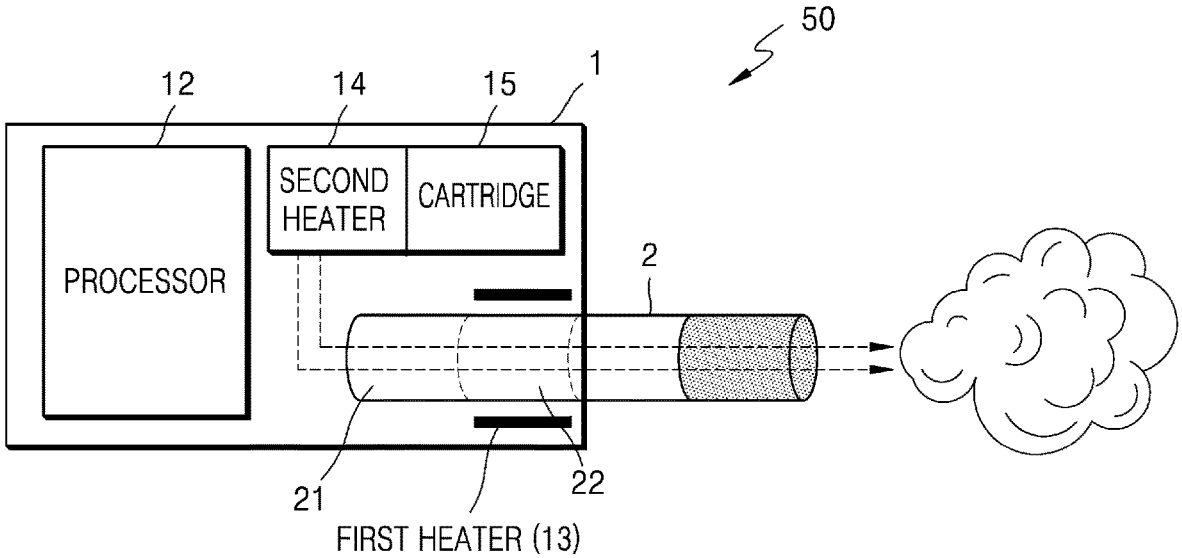
FIG. 6 illustrates an aerosol-generating system operating in a smoke mode, according to an embodiment.

FIG. 6 illustrates an aerosol-generating system operating in a smoke mode, according to an embodiment.

Referring to FIG. 6, the aerosol-generating system 50 may include the cigarette 2 and the aerosol-generating apparatus 1. The cigarette 2 may include the flavor unit 21 and the medium part 22. The aerosol-generating apparatus 1 may include the processor 12, the first heater 13, the second heater 14, and the cartridge 15. Also, the cigarette 2 may be inserted into the internal space of the aerosol-generating apparatus 1.

The cartridge 15 may store therein an aerosol-generating material. The aerosol-generating material stored in the cartridge 15 may be, for example, a liquid composition.

The aerosol-generating apparatus 1 may further include a main body (not illustrated). The cartridge 15 may be detachably coupled to the main body. The main body may include an accommodation space that may be coupled to the cartridge 15. However, one or more embodiments are not limited thereto, and the cartridge 15 may be coupled to one side surface of the main body. When the main body is coupled to the cartridge 15, the main body may be electrically connected to the cartridge 15.

The second heater 14 may heat the aerosol-generating material stored in the cartridge 15. The first heater 13 and the second heater 14 may each be an independent heater and may individually operate according to the control of the processor 12.

In the smoke mode, the aerosol-generating apparatus 1 may generate an aerosol including visible smoke. The processor 12 may independently control the first heater 13 and the second heater 14 to make the aerosol-generating apparatus 1 operate in the smoke mode. For example, the processor 12 may control the battery 11 to enable different amounts of power to supply to the first heater 13 and the second heater 14, respectively.

The aerosol-generating apparatus 1 may operate both the first heater 13 and the second heater 14 and thus may operate in a first smoke mode, in which an aerosol-generating material stored in the cartridge 15 and the cigarette 2 are heated, or a second smoke mode, in which only the cigarette 2 is heated by driving the first heater 13 only.

In the first smoke mode, the processor 12 may operate the first heater 13 and the second heater 14 to heat the aerosol-generating materials stored in both the cigarette 2 and the cartridge 15. The second heater 14 may heat the aerosol-generating material stored in the cartridge 15 at a temperature greater than or equal to an evaporation point. The aerosol evaporated from the aerosol-generating material may include the visible smoke.

In an embodiment, in the first smoke mode, the first heater 13 may indirectly heat the flavor unit 21 at a temperature greater than about 150° C. The first heater 13 may generate the visible smoke from the flavor unit 21 by indirectly heating the flavor unit 21 at a higher temperature than in the smoke-free mode. For example, the first heater 13 may directly heat the medium part 22 at a temperature greater than about 150° C. to enable the flavor unit 21 to be indirectly heated at a temperature greater than about 150° C. However, the temperature at which the flavor unit 21 and the medium part 22 are heated in the first smoke mode is not limited thereto, and the temperature may be differently determined according to types and a composition ratio of the materials included in the cigarette 2 and the settings of the aerosol-generating apparatus 1. In this case, visible smoke may be generated from both the cigarette 2 and the aerosol-generating material stored in the cartridge 15, and a greater amount of visible smoke may be generated than visible smoke generated from any one of the cigarette 2 and the aerosol-generating material.

In the second smoke mode, the processor 12 may only operate the first heater 13 from among the first heater 13 and the second heater 14 to heat the cigarette 2 only. In the second smoke mode, the first heater 13 may indirectly heat the flavor unit 21 at a temperature greater than about 150° C. The first heater 13 may generate the visible smoke from the flavor unit 21 by indirectly heating the flavor unit 21 at a higher temperature than in the smoke-free mode. For example, the first heater 13 may directly heat the medium part 22 at a temperature greater than about 150° C. to enable the flavor unit 21 to be indirectly heated at a temperature greater than about 150° C. In the second smoke mode, the temperature at which the flavor unit 21 and the medium part 22 are heated is not limited thereto, and the temperature may be differently determined according to types and composition ratios of materials included in the cigarette 2 and the settings of the aerosol-generating apparatus 1. In the second smoke mode in which the visible smoke is generated only from the cigarette 2, a less amount of visible smoke may be generated than in the first smoke mode in which the visible smoke is generated from the aerosol-generating material stored in the cartridge 15.

The aerosol-generating apparatus 1 may determine the generation of visible smoke by operating in one of the smoke-free mode and the smoke mode and may also determine the amount of visible smoke by controlling the first heater 13 and the second heater 14 in the smoke mode.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol-generating system comprising a cigarette and an aerosol-generating apparatus, wherein the cigarette comprises:

a medium part comprising a tobacco material;

a flavor unit comprising a flavoring material and a moisturizer; and a wrapper configured to wrap the medium part and the flavor unit, wherein the aerosol-generating apparatus comprises:

a first heater arranged on a portion corresponding to the medium part and configured to directly heat the medium part and indirectly heat the flavor unit by using heat transmitted through the wrapper, a processor configured to control the first heater to make the aerosol-generating apparatus operate in a smoke-free mode in which no visible smoke is generated, a cartridge configured to store an aerosol-generating material, and a second heater configured to heat the aerosol-generating material, wherein the processor is configured to individually control the first heater and the second heater to make the aerosol-generating apparatus operate in a smoke mode in which visible smoke is generated.

2. The aerosol-generating system of claim 1, wherein the first heater is configured to directly heat the medium part at a temperature, at which an aerosol containing the tobacco material is generated from the medium part but no visible smoke is generated, and indirectly heat the flavor unit at a temperature at which an aerosol containing the flavoring material is generated from the flavor unit but no visible smoke is generated.

3. The aerosol-generating system of claim 2, wherein the first heater is configured to directly heat the medium part at a temperature equal to or greater than about 120° C. and less than or equal to about 150° C. and indirectly heat the flavor unit at a temperature less than or equal to about 100° C.

4. The aerosol-generating system of claim 1, wherein the processor is configured to operate both the first heater and the second heater in a first smoke mode.

5. The aerosol-generating system of claim 4, wherein the first heater is configured to indirectly heat the flavor unit at a temperature greater than about 150° C.

6. The aerosol-generating system of claim 1, wherein the processor is configured to operate only the first heater from among the first heater and the second heater in a second smoke mode, and the first heater is configured to indirectly heat the flavor unit at a temperature greater than about 150° C.

7. The aerosol-generating system of claim 1, wherein the wrapper comprises a thermally conductive wrapper, and the first heater is configured to directly heat a first portion of the wrapper that corresponds to the medium part and indirectly heat the flavor unit by using heat transmitted from the first portion of the wrapper to a second portion of the wrapper that corresponds to the flavor unit.

8. The aerosol-generating system of claim 1, wherein the tobacco material is obtained by cooling or reducing a component that is evaporated or volatilized through thermal treatment of pipe tobacco powder at a temperature between about 200° C. and about 250° C.

9. The aerosol-generating system of claim 1, wherein the flavor unit comprises a flavoring material of between about 4.2 mg and about 30 mg.

* * * * *